US011268758B2

(12) United States Patent
Sanfilippo et al.

(10) Patent No.: US 11,268,758 B2
(45) Date of Patent: Mar. 8, 2022

(54) DRYER

(71) Applicants: Lillian Sanfilippo, Altadena, CA (US); James Sanfilippo, Altadena, CA (US)

(72) Inventors: Lillian Sanfilippo, Altadena, CA (US); James Sanfilippo, Altadena, CA (US)

( * ) Notice: Subject to any disclaimer, the term of this patent is extended or adjusted under 35 U.S.C. 154(b) by 43 days.

(21) Appl. No.: 16/914,839

(22) Filed: Jun. 29, 2020

(65) Prior Publication Data

US 2020/0326125 A1 Oct. 15, 2020

Related U.S. Application Data

(63) Continuation-in-part of application No. 15/960,084, filed on Apr. 23, 2018, now Pat. No. 10,731,920.

(51) Int. Cl.

| | |
|---|---|
| ***F26B 19/00*** | (2006.01) |
| ***F26B 5/02*** | (2006.01) |
| ***A45D 20/00*** | (2006.01) |
| ***F26B 5/12*** | (2006.01) |

(52) U.S. Cl.

CPC ..... *F26B 5/02* (2013.01); *A45D 20/00* (2013.01); *F26B 5/12* (2013.01); *A45D 2200/207* (2013.01)

(58) Field of Classification Search

CPC ..... F26B 5/02; F26B 5/12; F26B 3/36; A45D 20/00; A45D 20/48; A45D 2200/207; A45D 2200/205; A45D 20/50; A45D 20/30; A45D 20/34

USPC ..... 34/69, 397, 401

See application file for complete search history.

(56) References Cited

U.S. PATENT DOCUMENTS

| | | | | |
|---|---|---|---|---|
| 10,251,459 | B2 * | 4/2019 | Lee | A45D 20/12 |
| 2011/0209721 | A1 * | 9/2011 | Yahnker | A45D 20/12 132/271 |
| 2016/0150864 | A1 * | 6/2016 | Thomason | A45D 20/00 34/283 |
| 2018/0036553 | A1 * | 2/2018 | Shiibashi | A45D 20/12 |

* cited by examiner

*Primary Examiner* — John P McCormack

(74) *Attorney, Agent, or Firm* — Chip Law Group

(57) ABSTRACT

A dryer for drying hair or clothes is disclosed. The dryer includes a head and a handle attached to the head. The dryer further includes ultrasonic devices, a controller, a vacuum pump, and a reservoir. The head has a surface on which inlet holes are formed. The ultrasonic devices are positioned on the surface of the head. The ultrasonic devices produce ultrasonic vibrations that break down water molecules into mist. The controller controls an operation of the ultrasonic devices.

10 Claims, 10 Drawing Sheets

DRYER

CROSS-RELATED APPLICATIONS

This application is a continuation-in-part of U.S. patent application Ser. No. 15/960,084, filed Apr. 23, 2018, the contents of which are incorporated herein by reference.

FIELD OF THE INVENTION

The present invention relates to drying apparatuses, and more particularly to a drying apparatus that improves drying efficiency.

BACKGROUND

The traditional method of drying hair or clothes, involved drying in open-air. The time taken by the traditional method to completely dry the hair or clothes depends on several factors, such as temperature, humidity level, environmental factors such as wind effect or sun shine, characteristics of the hair including curliness, thickness, length, amount and volume of hair, and characteristics of the clothes such as thickness and materials of fabric. The traditional method involves temperature-dependent evaporation of water molecules from a surface of the hair or clothes. The evaporation rate depends on a vapor pressure of water for a given temperature, humidity level, or various above-mentioned environmental parameters. Thus, depending on the temperature, pressure, humidity level, and the available surface area and morphology of a wet object, the vapor pressure of water may vary and thus affect the evaporative drying process. Therefore, the drying process may require a significant amount of time.

The above-mentioned problem of the traditional method is solved by modern dryers. The dryers use a mechanism for heating the hair to a high temperature (higher than natural, ambient, or room temperature) to accelerate the water evaporation. The dryers typically include a blower with a heating element that generates hot air with a sufficiently high temperature to evaporate water. When the hot air comes in contact with the surface of the hair, the sufficiently high temperature of the air evaporates the water molecules, thereby drying the hair.

While the dryers reduce the time taken in drying the hair, they cause various undesirable effects, including damage to the hair. The hair is essentially composed of proteins and as proteins contain water, the removal of water molecules from the surface of the hair inevitably and irreversibly removes water molecules from the protein structure as well. Alternatively stated, while using the dryers, hair may be burned and the protein in the hair can be irreversibly damaged when exposed to the high temperature air. For wet hair, water molecules inside bundles of hair hold the individual strands of hair via water tension. For example, if the wet hair agglomerates into several bundles of hair, blow-drying with a dryer will usually evaporate the outer water molecules on the bundled hair before reaching the inner water molecules that reside inside the bundled hair. Removing inner water molecules inside the wet bundled hair can over expose the outer hair or individual hair strands that have been completely dried, to the high temperature air, and the already-dried hair may then get irreversibly damaged due to the high temperature air.

Moreover, the dryers consume high amount of power due to high power-drawn by the heating element. Typically, the dryers consume about two kilowatts of energy to operate.

Therefore, given their large-scale use and frequency of use (on average at least 4-5 times per week per person), the dryers consume a substantial amount of energy. Further, surface area for drying is limited by the construction of the blowers. To increase the surface area for drying, sizes of the blowers have to be increased, which in turn increases the power consumption of the dryers. High power consumption and high temperature operation inadvertently limit the use of the dryers to plug-in operations (i.e., connected to an electrical outlet to draw power), thus reducing the portability of the dryers. At the same time, extreme care needs to be taken while using or operating the dryers with potentially hot surfaces that can burn when inappropriately held. Hence, the dryers are not safe for use for children, elderly people, and the like.

In light of the foregoing, there exists a need for a significantly improved dryer for drying hair or clothes. Also, there exists a need for a dryer that solves the above-mentioned problems and provides an improved and efficient drying mechanism for drying the hair or clothes. Finally, it is desirable that the dryer is more portable as compared to the modern dryers.

SUMMARY OF THE INVENTION

In an embodiment of the present invention, a dryer is disclosed. The dryer includes a head, a handle, a plurality of ultrasonic devices, and a controller. The handle is attached to the head. The plurality of ultrasonic devices are positioned on a surface of the head. The plurality of ultrasonic devices produce ultrasonic vibrations that break down water molecules into mist. The controller controls an operation of the plurality of ultrasonic devices. The dryer further includes a suction unit and a reservoir. A plurality of inlet holes are formed on the surface of the head. The suction unit is positioned inside the head to generate vacuum that draws the mist towards the surface of the head. The reservoir is positioned inside the handle to collect the mist generated by the plurality of the ultrasonic devices.

The dryer further comprises a plurality of control circuits corresponding to the plurality of ultrasonic devices. The plurality of control circuits are connected to the controller for receiving at least one control signal. The plurality of control circuits control the operation of the corresponding plurality of the ultrasonic devices based on the at least one control signal. Each of the plurality of ultrasonic devices is a piezoelectric transducer. The dryer further comprises a plurality of bristles protruding from the surface of the head. The plurality of bristles are detachably attached to the head. The dryer further comprises a power source to power the dryer. The power source is at least one of a direct current (DC) or an alternating current (AC) power source. The dryer further comprises a control switch to control an operation of the dryer.

In another embodiment of the present invention, a dryer includes a head having a surface and a handle attached to the head. The dryer further includes a plurality of ultrasonic devices positioned on the surface of the head. The plurality of ultrasonic devices produce ultrasonic vibrations that break down water molecules into mist. Further, the dryer includes a disinfection chamber positioned inside the head to disinfect the mist. A suction fan is in fluidic communication with the disinfection chamber to generate vacuum that draws the mist towards the surface of the head and into the disinfection chamber. A controller controls operation of the plurality of ultrasonic devices and the suction fan.

The dryer uses ultrasonic devices instead of hot air for drying hair. Hence, the hair is prevented from damage caused due to excess heat. The positioning of the ultrasonic devices on the surface of the head ensures that a portion of hair or clothes which is in contact with the head of the dryer is dried completely. Thus, the drying effect is achieved in a single pass of the dryer over the hair or clothes. This results in a significant reduction in time required to dry the hair or clothes. The dryer consumes significantly less power as compared to that consumed by the conventional dryers. This is because the dryer does not use hot air for drying and hence eliminates the need for blowers with a heating element. The elimination of the blowers and absence of the heating element makes the dryer safe to use. The reduction in power consumption allows for use of the DC power source that makes the dryer portable.

BRIEF DESCRIPTION OF THE DRAWINGS

The accompanying drawings illustrate the various embodiments of systems, methods, and other aspects of the invention. It will be apparent to a person skilled in the art that the illustrated element boundaries (e.g., boxes, groups of boxes, or other shapes) in the figures represent one example of the boundaries. In some examples, one element may be designed as multiple elements, or multiple elements may be designed as one element. In some examples, an element shown as an internal component of one element may be implemented as an external component in another, and vice versa.

Various embodiments of the present invention are illustrated by way of example, and not limited by the appended figures, in which like references indicate similar elements.

Further areas of applicability of the present invention will become apparent from the detailed description provided hereinafter. It should be understood that the detailed description of exemplary embodiments is intended for illustration purposes only and is, therefore, not intended to necessarily limit the scope of the invention.

DETAILED DESCRIPTION

The present invention is best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. In one example, the teachings presented and the needs of a particular application may yield multiple alternate and suitable approaches to implement the functionality of any detail described herein. Therefore, any approach may extend beyond the particular implementation choices in the following embodiments that are described and shown.

References to "an embodiment", "another embodiment", "yet another embodiment", "one example", "another example", "yet another example", "for example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

Be it known that, throughout this application, wet hair and clothes are used as examples that are subjected to drying, but devices as described herein can also be applicable to any other wet objects, including objects that have hair-like structures, such as strands, filaments, fibers, etc. of any material or chemical composition, including cottons, nylons, synthetic or natural materials, organic or inorganic materials, composite materials etc.

Figure 1A:
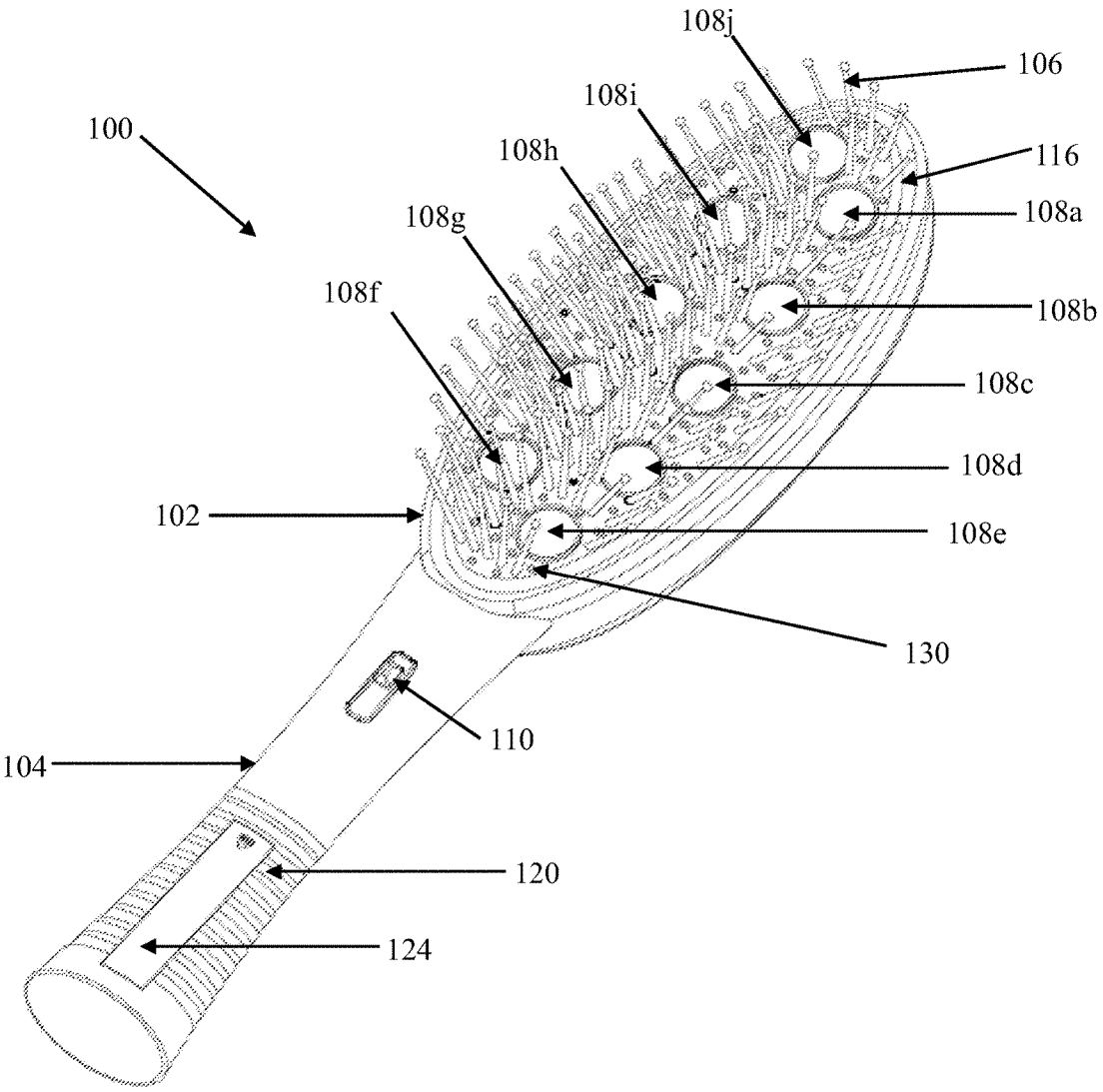
FIG. 1A illustrates a perspective view of a dryer, in accordance with an embodiment of the present invention.
Figure 1B:
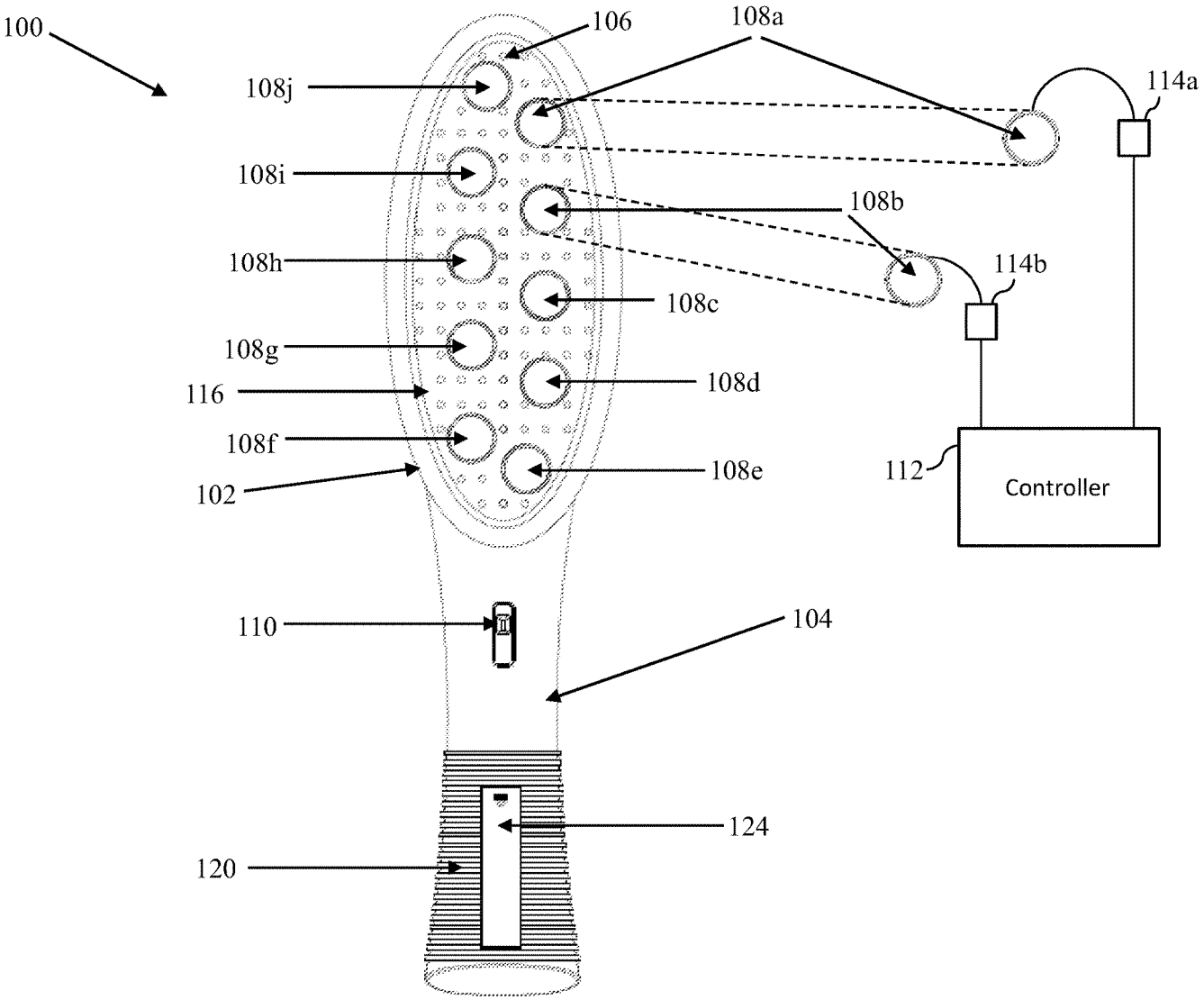
FIG. 1B illustrates a front view of the dryer of FIG. 1A, in accordance with an embodiment of the present invention.
Figure 1C:
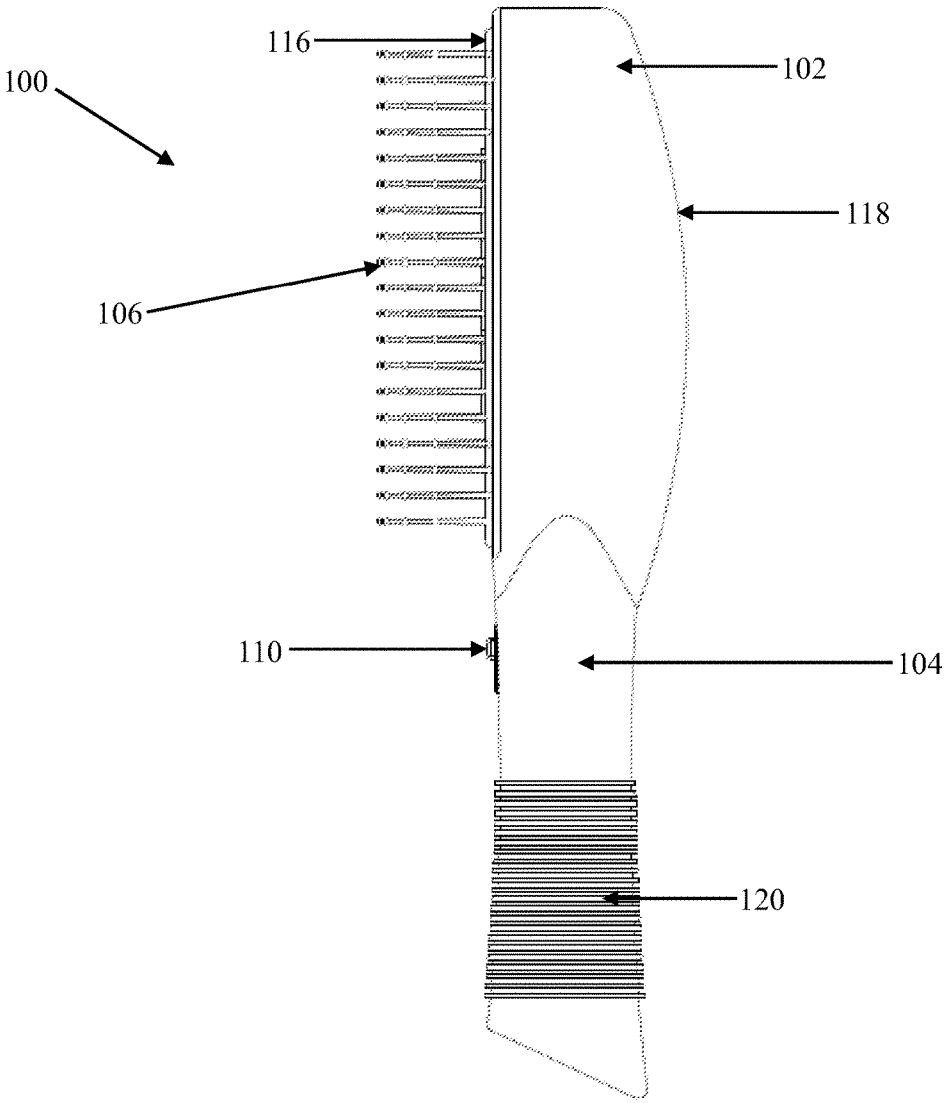
FIG. 1C illustrates a side view of the dryer of FIG. 1A, in accordance with an embodiment of the present invention.

FIGS. 1A, 1B, and 1C illustrate a perspective view, a front view, and a side view of the dryer 100, in accordance with an embodiment of the present invention, respectively. The dryer 100 is used for drying wet hair (or simply "hair") and clothes. As illustrated in FIGS. 1A-1C, the dryer 100 includes a head 102, a handle 104, a set of bristles 106, a set of ultrasonic devices 108*a*-108*j*, a control switch 110, a controller 112, and first and second control circuits 114*a* and 114*b* (collectively referred to as control circuits 114).

The head 102 has a hollow structure between first and second surfaces 116 and 118 (shown in FIG. 1C). The set of ultrasonic devices 108*a*-108*j* is secured on the first surface 116 of the head 102. The handle 104 has a hollow cylindrical structure that accommodates control elements, such as electrical components and circuitry that generally control and support the operation of the dryer 100. The control switch 110 is mounted on the handle 104 such that the control switch 110 is operable by a user to control an operation of the dryer 100. In an embodiment, the handle 104 can be detachably attached to the head 102. The handle 104 may also have a hollow cuboidal structure, a hollow cubical structure, or the like. The handle 104 includes a grip 120 that substantially covers the handle 104 and assists in firm holding of the dryer 100. The grip 120 ensures that the handle 104 has a smooth surface. The grip 120 can be made of a resiliently deformable material. In an embodiment, the head 102 and handle 104 are made of a variety of materials, including but not limited to, plastics, metals, ceramics, fibers, organic materials, woven fibers, rubbers, resins, and the like, and composites thereof.

The head 102 includes the set of bristles 106 that protrudes from the first surface 116 of the head 102 attached thereto. The set of bristles 106 may be disposed in longitudinal rows or in any other suitable pattern. In an embodiment, the set of bristles 106 can be detachably attached to the first surface 116 of the head 102. The head 102 has a provision to attach and detach the set of bristles 106 thereon. In another embodiment, the set of bristles 106 is a part of a bristle attachment (not shown) that enables collectively attaching the set of bristles 106 onto the first surface 116 of the head 102. The bristle attachment has same size and dimensions as that of the first surface 116 of the head 102. The bristle attachment can be easily secured to the head 102 by adhering with an adhesive, frictional interference, snap fit, or fasteners. The design of the bristle attachment ensures that the set of bristles 106 does not cover the first surface 116 entirely. In an example, the set of bristles 106 is attached to the first surface 116 of the head 102 when the dryer 100 is used for drying wet hair. The set of bristles 106 is detached from the first surface 116 of the head 102 when the dryer 100 is used for drying wet objects, such as clothes, fabrics, or the like. The set of bristles 106 holds the wet hair against the set of ultrasonic devices 108*a*-108*j*. The set of bristles 106 prevents the wet hair from forming a bundle. This helps in efficiently drying the wet hair or the objects having hair-like structures. In an embodiment, the set of bristles 106 is made of any suitable material, including but not limited to, polymers, plastics, rubber, silicone, recycled materials, natural and/or eco-friendly materials, biodegradable materials, and combinations thereof.

The set of ultrasonic devices 108*a*-108*j* is secured on the first surface 116 of the head 102. In an embodiment, the set of ultrasonic devices 108*a*-108*j* can be secured to the head 102 by using an adhesive. The set of ultrasonic devices 108*a*-108*j* does not overlap with the set of bristles 106. The set of ultrasonic devices 108*a*-108*j* is piezoelectric transducers, specifically piezoelectric ceramic discs. The set of ultrasonic devices 108*a*-108*j* produces ultrasonic vibrations that break down water molecules present on a surface of the hair or clothes into mist. In an embodiment, each ultrasonic device of the set of ultrasonic devices 108*a*-108*j* is an ultrasonic mist maker. The number and position of ultrasonic devices 108*a*-108*j* may be varied such that the set of ultrasonic devices 108*a*-108*j* may efficiently and in entirety break down the water molecules from a portion of the hair that is in contact with the dryer 100. For example, the dryer 100 may include 8, 10, or 12 ultrasonic devices to achieve effective drying of the hair or clothes. In a scenario when the dryer 100 is used for drying wet hair, the number and position of set of ultrasonic devices 108*a*-108*j* on the first surface 116 ensure that the all the wet hair passing through the head 102 of the dryer 100 is dried. Thus, a coverage provided by the number and position of the set of ultrasonic devices 108*a*-108*j* on the dryer 100 ensures that the wet hair may be dried by a single pass of the dryer 100, thus ensuring that the wet hair is dried in a significantly small amount of time.

The controller 112 controls the set of ultrasonic devices 108*a*-108*j* by way of the control circuits 114 and based on a state of the control switch 110. The control circuits 114 are connected to the set of corresponding ultrasonic devices 108*a*-108*j*. For example, the first and second control circuits 114*a* and 114*b* are connected to first and second ultrasonic devices 108*a* and 108*b*, respectively. The first and second control circuits 114*a* and 114*b* control an operation of the first and second ultrasonic devices 108*a* and 108*b*, respectively. In an embodiment, the control circuits 114 are connected to the controller 112 and receive a set of control signals. In another embodiment, the control circuits 114 are connected to the controller 112 and receive a control signal. In an embodiment, the controller 112 is positioned inside the handle 104.

The controller 112 controls the operation of the control circuits 114 by way of the set of control signals and based on the state of the control switch 110. If the control switch 110 is in an ON state, the controller 112 generates the set of control signals to activate the control circuits 114 which in turn activate the corresponding set of ultrasonic devices 108*a*-108*j*. If the control switch 110 is in an OFF state, the controller 112 generates the set of control signals to deactivate the control circuits 114 which in turn deactivate the set of ultrasonic devices 108*a*-108*j*. The control circuits 114 may include electrical switches, latches, or the like. In an example, each control signal of the set of control signals is similar. Hence, each ultrasonic device of the set of ultrasonic devices 108*a*-108*j* may be activated or deactivated simultaneously. In another example, a first subset of control signals of the set of control signals is different from a second subset of control signals of the set of control signals. Hence, a first subset of ultrasonic devices of the set of ultrasonic devices 108*a*-108*j* controlled by the corresponding first subset of control signals is activated and a second subset of ultrasonic devices of the set of ultrasonic devices 108*a*-108*j* controlled by the corresponding second subset of control signals is deactivated. In one embodiment, the dryer 100 may include a set of sensors (not shown) that senses a proximity of water thereto. The controller 112 may receive sensor data from the set of sensors and output the set of control signals based on the sensor data. For example, a sensor placed in a vicinity of an ultrasonic device 108*a* may output the sensor data indicating if a wet object is in contact with the ultrasonic device 108*a*. Based on the sensor data, the controller 112 may output a control signal to activate the corresponding ultrasonic device 108*a*.

A power source 122 (shown in FIG. 1D) powers the dryer 100. The power source 122 is used to provide power to the set of ultrasonic devices 108*a*-108*j*, the controller 112, and the control circuits 114. The power source 122 is positioned inside the handle 104 and is removable. In an embodiment, the power source 122 is a direct current (DC) power source, such as a battery. The use of the DC power source makes the dryer 100 portable. The power source 122 can be recharged by using an on-board charging circuit (not shown) or a Universal Serial Bus (USB) power source. The handle 104 includes a battery compartment 124 that facilitates removal of the power source 122. In another embodiment, the dryer 100 includes an electrical cord (not shown) that extends from the handle 104. The electrical cord allows the dryer 100 to connect to an alternating current (AC) power source. The electrical cord may be detachable from the handle 104. In an example, power is directly supplied from power mains. In another example, the dryer 100 includes a rechargeable battery that supplies power to the dryer 100. The dryer 100 may further include an AC-DC (AC to DC) converter that receives an AC power supply from the power mains and converts it into a DC signal. The AC-DC converter is explained further in conjunction with FIG. 2.

Figure 1D:
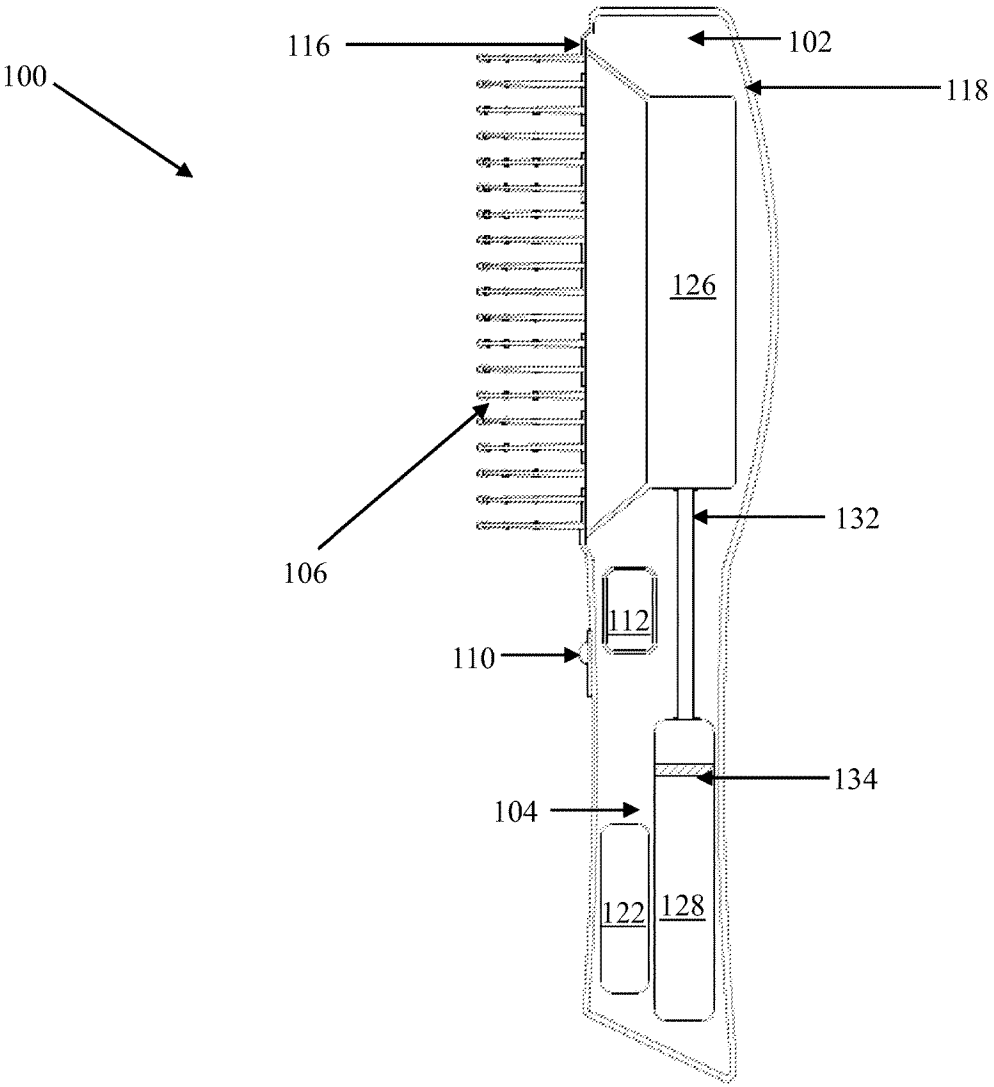
FIG. 1D illustrates a side sectional view of the dryer of FIG. 1A, in accordance with an embodiment of the present invention.

FIG. 1D illustrates a side sectional view of the dryer 100, in accordance with an embodiment of the present invention. As illustrated in FIG. 1D, the dryer 100 further includes a vacuum pump 126 and a reservoir 128. The vacuum pump 126 is a suction unit positioned inside the head 102. Once the set of ultrasonic devices 108*a*-108*j* breaks down the water molecules from the surface of the hair or clothes, it is important to remove the mist thus formed. A failure in removal of the mist from the vicinity of the hair or clothes would result in absorption of the mist (which eventually condenses into water molecules) by the clothes or spread of the mist on the hair. This would render the drying process ineffective. The vacuum pump 126 ensures that the mist formed is immediately removed from the vicinity of the hair or clothes. The vacuum pump 126 generates vacuum that draws the mist towards the first surface 116 of the head 102. In an embodiment, an impeller, a fan, or the like may be used in place of the vacuum pump 126. The vacuum pump 126 receives power from the power source 122. The head 102 has a set of inlet holes 130 (shown in FIG. 1A) formed on its first surface 116 that allow the vacuum pump 126 to draw the mist towards the first surface 116 of the head 102. The set of inlet holes 130 is strategically positioned on the first surface 116 of the head 102 such that the mist formed is completely drawn into the vacuum pump 126. The vacuum pump 126 collects the mist. Further, the mist can condense into the water molecules inside the vacuum pump 126. The vacuum pump may be removable by way of an opening (not shown) formed on the second surface 118 of the head 102.

The reservoir 128 is positioned inside the handle 104 and is connected to the vacuum pump 126 by way of a conduit 132. When the reservoir 128 receives the mist from the vacuum pump 126, the mist may be condensed into the water molecules inside the conduit 132 before the mist enters the reservoir 128. The mist may also be condensed inside the reservoir 128. The reservoir 128 thus stores the water. In an example, the mist is condensed into the water molecules through natural convection. The reservoir 128 may be a chamber or a tank. The reservoir 128 may have an absorbent material 134 which is replaceable with a dry absorbent material once it absorbs a predefined amount of water molecules. The conduit 132 further includes a back-flow check valve or a one-way valve (not shown) that allows a passage of the water molecules and the mist from the vacuum pump 126 to reservoir 128 but prevents the passage of the water molecules from the reservoir 128 to the vacuum pump 126. This ensures that the dryer 100 can be held upside-down without encountering a possibility of the water molecules circulating back into the vacuum pump 126. The reservoir 128 is removable by way of an opening (not shown) formed on the surface of the handle 104. The reservoir 128 can be drained or replaced once the water level in the reservoir 128 crosses a predetermined threshold level. In an embodiment, the handle 104 may have a transparent portion suitably formed therein, which allows the user to check the water level inside the reservoir 128. In another embodiment, the handle 104 may include a display (not shown) that provides an indication of the water level inside the reservoir 128. In yet another embodiment, the handle 104 may include a Light Emitting Diode (LED) that gives an indication when the reservoir 128 is full. In one embodiment, the reservoir 128 is made of plastic.

Figure 1E:
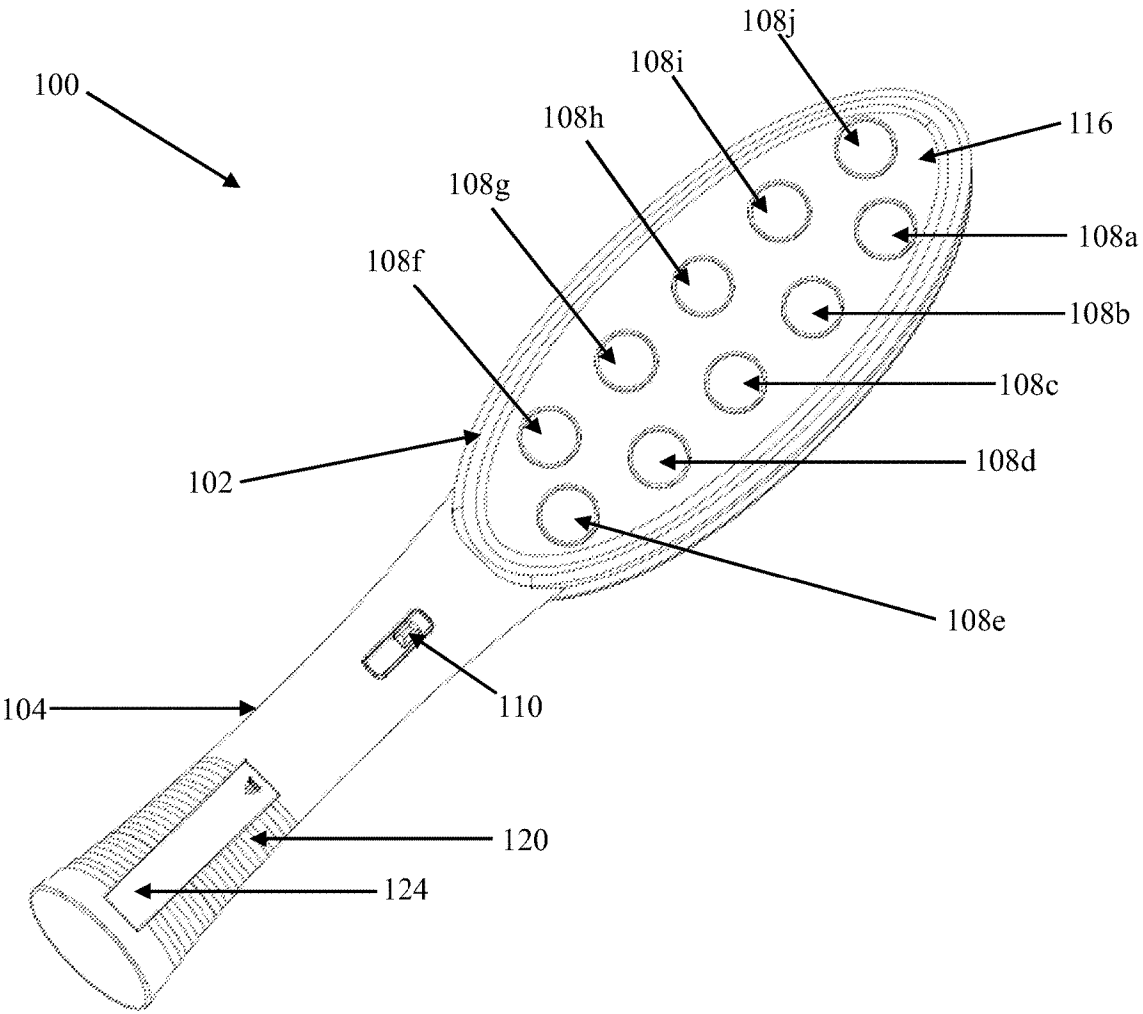
FIG. 1E illustrates a perspective view of the dryer, in accordance with another embodiment of the present invention.

FIG. 1E illustrates a perspective view of the dryer 100, in accordance with another embodiment of the present invention. The dryer 100 of FIG. 1E is similar in functionality to the dryer 100 of FIG. 1A. Structurally, the dryer 100 of FIG. 1E is devoid of the set of bristles 106, i.e., the set of bristles 106 is detached from the first surface 116 of the head 102. The dryer 100 of FIG. 1E can be used to dry wet objects such as clothes, e.g., wet clothes. The absence of the set of bristles 106 on the first surface 116 of the head 102 allows that the dryer 100 of FIG. 1E to be used for drying clothes by ensuring direct contact between the set of ultrasonic devices 108*a*-108*j* and the clothes.

Figure 2:
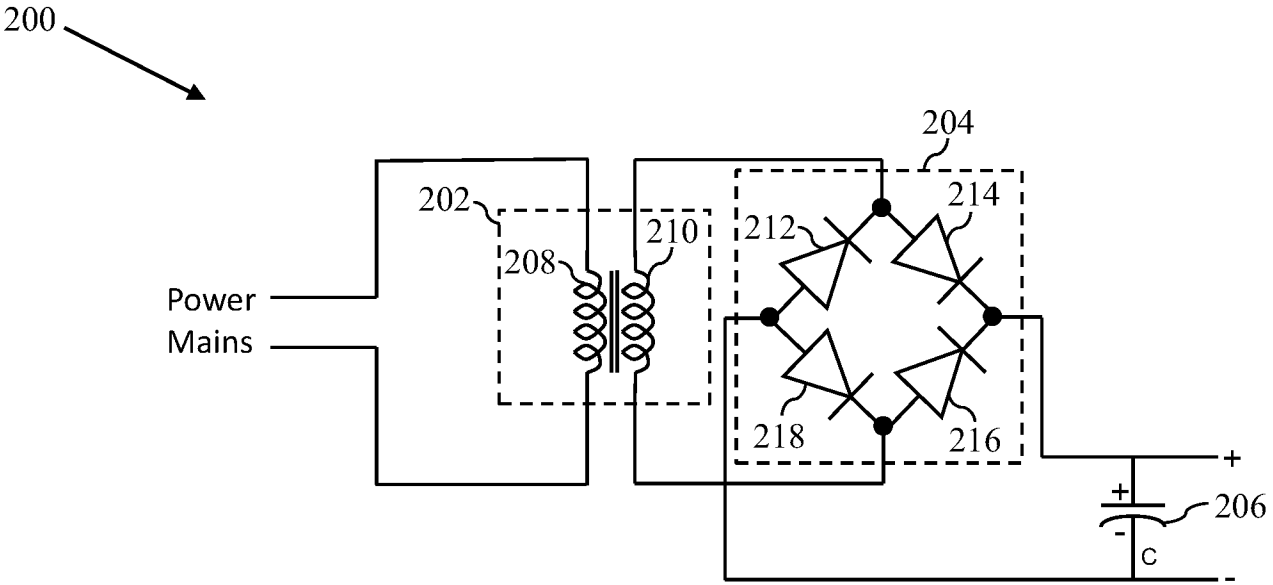
FIG. 2 illustrates an alternating current (AC)-direct current (DC) (AC to DC) converter, in accordance with an embodiment of the present invention.

FIG. 2 illustrates the AC-DC converter 200, in accordance with an embodiment of the present invention. The AC-DC converter 200 includes a transformer 202, a bridge rectifier 204, and a capacitor 206. The transformer 202 is a step-down transformer that includes primary and secondary coils 208 and 210. The primary coil 208 of the transformer 202 receives the AC supply from the power mains and an induced voltage is outputted across the secondary coil 210. For example, the primary coil 208 of the transformer 202 receives 120V from the power mains and the induced voltage across the secondary coil 210 is 8.5V. The bridge rectifier 204 includes first through fourth diodes 212-218 arranged in form of a bridge. The rectification, i.e., conversion from AC to DC is achieved by way of the first through fourth diodes 212-218. A DC signal outputted by the bridge rectifier 204 includes ripples. The capacitor 206 is used to provide a smoothed DC signal. In an example, a voltage level of the DC signal is 24V.

In operation, the user activates the dryer 100 by way of the control switch 110. When the dryer 100 is activated, the controller 112 activates the control circuits 114 which in turn activate the set of ultrasonic devices 108*a*-108*j*. Upon activation, the set of ultrasonic devices 108*a*-108*j* produces ultrasonic vibrations. The user now brings the dryer 100 near hair. Upon contact with the hair, the ultrasonic vibrations break down the water molecules from a surface of the hair, thereby removing water molecules from the hair and drying them in the process. The mist thus formed is removed from the vicinity of the hair or clothes by the vacuum pump 126. The vacuum pump 126 is activated at the same time instance that the set of ultrasonic devices 108*a*-108*j* is activated. In an embodiment, the controller 112 controls an operation of the vacuum pump 126. The vacuum pump 126 creates vacuum that draws the mist towards the first surface 116 of the head 102 of the dryer 100 and inside the vacuum pump 126 by way of the set of inlet holes 130. Once inside the vacuum pump 126, the mist may get converted into the water molecules which are then collected inside the reservoir 128 by way of the conduit 132.

Specific advantages of the present invention include the use of the dryer 100 to remove water from the hair or clothes. The dryer 100 does not use hot air and instead uses the ultrasonic vibrations to remove the water molecules from the hair or clothes. The ultrasonic vibrations may also result in more uniform distribution of heat. With lowered amounts of applied heat, the likelihood or risk of damage to the hair decreases. Further, the positioning of the set of ultrasonic devices 108*a*-108*j* on the first surface 116 of the head 102 ensures that a portion of the hair or clothes that is in contact with the head 102 is dried completely. Thus, the drying effect is achieved in a single pass of the dryer 100 over the hair or clothes. This represents a significant reduction in time required to dry the hair or clothes. Further, the use of the set of ultrasonic devices 108*a*-108*j*, the vacuum pump 126, and the reservoir 128 ensures that the hair is dried in a significantly efficient manner as compared to dryers known in the art. This is because the mist generated is instantly removed from the hair, thereby preventing it from getting spread back on the hair. The dryer 100 is lighter in weight than the conventional dryers because of the use of light-weight components, such as the set of ultrasonic devices 108*a*-108*j*, the power source 122, the vacuum pump 126, and the reservoir 128. Further, the dryer 100 provides more surface area for drying than the conventional dryers. The power consumed by the dryer 100 is significantly less than the power consumed by the conventional dryers. This is because the dryer 100 does not use hot air for drying and hence eliminates the need for blowers with a heating element. Further, the use of the vacuum pump 126 requires a significantly less amount of power than the blowers. This significantly reduces the amount of power consumed by the dryer 100. The elimination of the blowers and absence of hot air makes the dryer safer to use for children, elderly people, or the like in comparison to the conventional dryers. The reduction in power consumption allows for use of the DC power source that makes the dryer 100 portable.

Figure 3A:
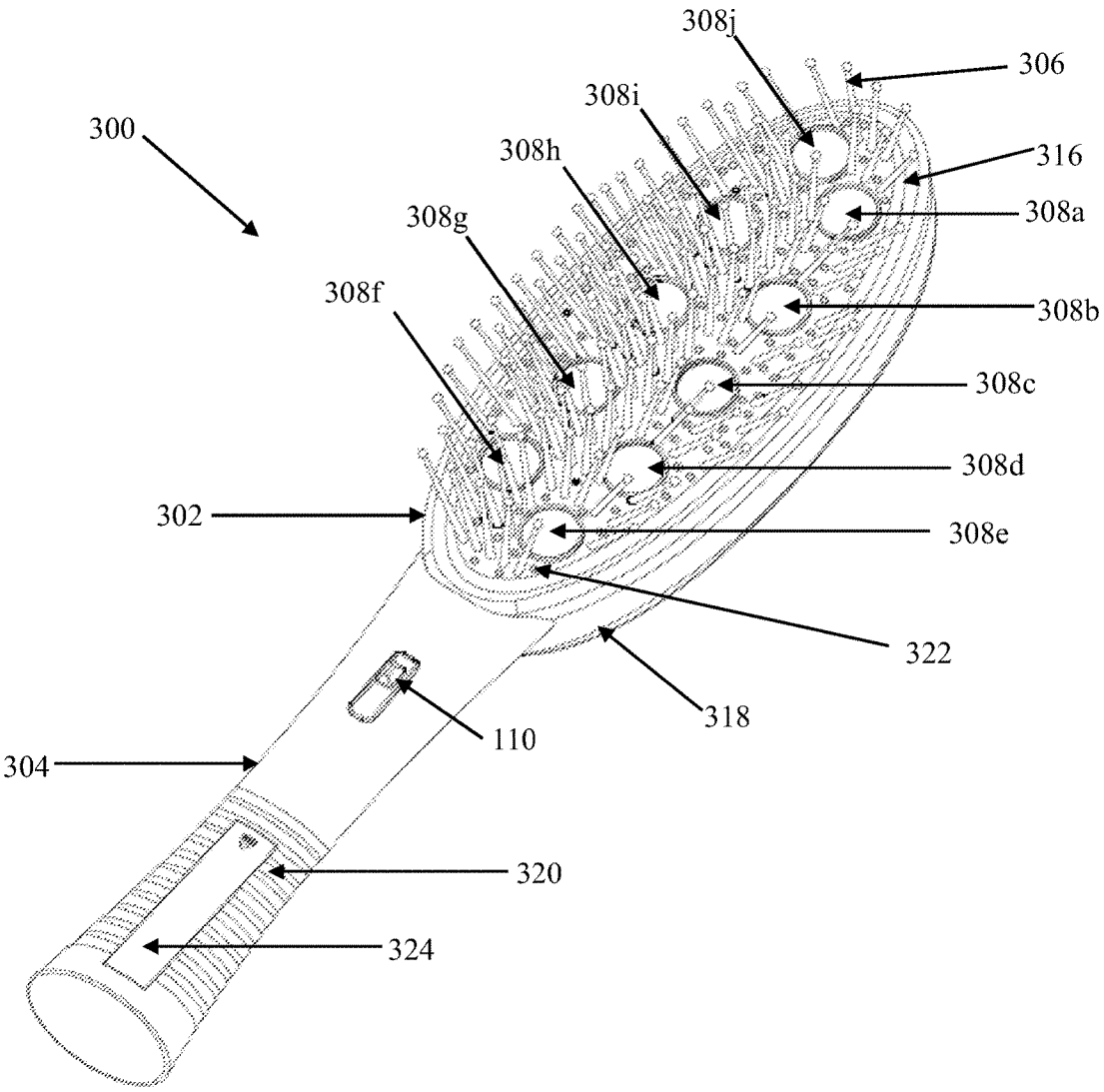
FIG. 3A illustrates a perspective view of a modified dryer, in accordance with an embodiment of the present invention.
Figure 3B:
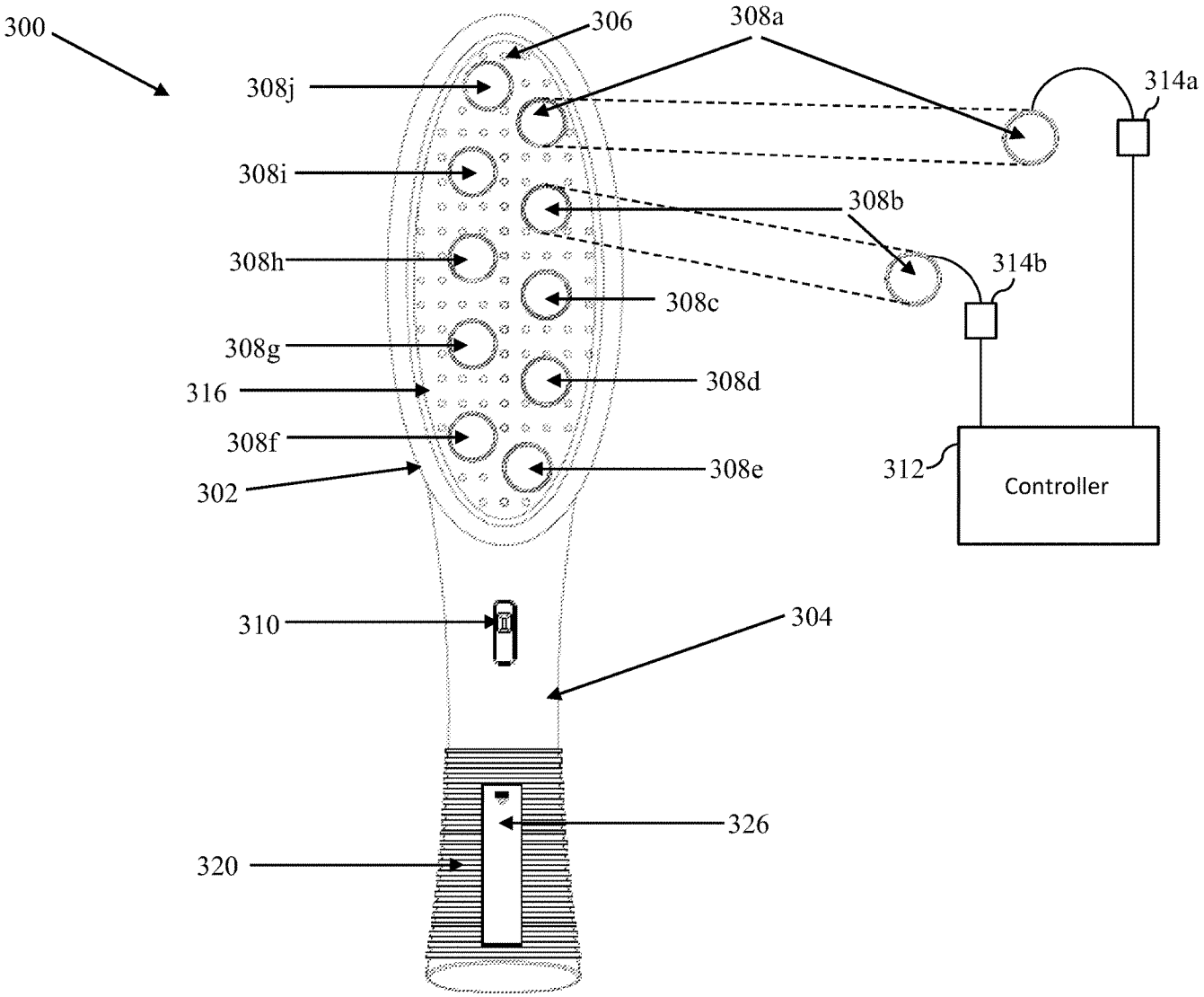
FIG. 3B illustrates a front view of the modified dryer of FIG. 3A, in accordance with an embodiment of the present invention.

In another embodiment of the invention, a modified dryer 300 is illustrated in FIGS. 3A and 3B. FIGS. 3A and 3B illustrate a perspective view and a front view of the modified dryer 300, in accordance with an embodiment of the present invention, respectively. The modified dryer 300 functions similar as the dryer 100. As illustrated in FIGS. 3A-3B, the modified dryer 300 includes a head 302, a handle 304, a set of bristles 306, a set of ultrasonic devices 308*a*-308*j*, a control switch 310, a controller 312, and first and second control circuits 314*a* and 314*b* (collectively referred to as control circuits 314). The head 302, the handle 304, the set of bristles 306, the set of ultrasonic devices 308*a*-308*j*, the control switch 310, the controller 312, and the first and second control circuits 314*a* and 314*b* are structurally and functionally similar to the head 102, the handle 104, the set of bristles 106, the set of ultrasonic devices 108*a*-108*j*, the control switch 110, the controller 112, and the first and second control circuits 114*a* and 114*b*, respectively.

The head 302 has a hollow structure between first and second surfaces 316 and 318. The set of ultrasonic devices 308*a*-308*j* is secured on the first surface 316 of the head 302. The handle 304 has a hollow cylindrical structure that accommodates control elements, such as electrical components and circuitry that generally control and support the operation of the modified dryer 300. The control switch 310 is mounted on the handle 304 such that the control switch 310 is operable by a user to control an operation of the modified dryer 300. In an embodiment, the handle 304 can be detachably attached to the head 302. The handle 304 includes a grip 320 that substantially covers the handle 304 and assists in firm holding of the modified dryer 300. The grip 320 ensures that the handle 304 has a smooth surface.

The head 302 includes the set of bristles 306 that protrudes from the first surface 316 of the head 302 attached thereto. In an embodiment, the set of bristles 306 can be detachably attached to the first surface 316 of the head 302. In an example, the set of bristles 306 is attached to the first surface 316 of the head 302 when the modified dryer 300 is used for drying wet hair. The set of bristles 306 is detached from the first surface 316 of the head 302 when the modified dryer 300 is used for drying wet objects, such as clothes, fabrics, or the like. The set of bristles 306 holds the wet hair against the set of ultrasonic devices 308*a*-308*j*. The set of bristles 306 prevents the wet hair from forming a bundle. This helps in efficiently drying the wet hair or the objects having hair-like structures.

The set of ultrasonic devices 308*a*-308*j* is secured on the first surface 316 of the head 302. The set of ultrasonic devices 308*a*-308*j* is piezoelectric transducers, specifically piezoelectric ceramic discs. The set of ultrasonic devices 308*a*-308*j* produces ultrasonic vibrations that break down water molecules present on a surface of the hair or clothes into mist. In an embodiment, each ultrasonic device of the set of ultrasonic devices 308*a*-308*j* is an ultrasonic mist maker. The head 302 has a set of inlet holes 322 (shown in FIG. 1A) formed on the first surface 316. The set of inlet holes 322, the set of bristles 306, and the set of ultrasonic devices 308*a*-308*j* do not overlap with each other.

As shown in FIG. 3B, the controller 312 controls the set of ultrasonic devices 308*a*-308*j* by way of the control circuits 314 and based on a state of the control switch 310. The control circuits 314 are connected to the set of corresponding ultrasonic devices 308*a*-308*j*. For example, the first and second control circuits 314*a* and 314*b* are connected to first and second ultrasonic devices 308*a* and 308*b*, respectively. The first and second control circuits 314*a* and 314*b* control an operation of the first and second ultrasonic devices 308*a* and 308*b*, respectively. In an embodiment, the control circuits 314 are connected to the controller 312 and receive a set of control signals. In an embodiment, the controller 312 is positioned inside the handle 304.

The controller 312 controls the operation of the control circuits 314 by way of the set of control signals and based on the state of the control switch 310. If the control switch 310 is in an ON state, the controller 312 generates the set of control signals to activate the control circuits 314 which in turn activate the corresponding set of ultrasonic devices 308*a*-308*j*. If the control switch 310 is in an OFF state, the controller 312 generates the set of control signals to deactivate the control circuits 314 which in turn deactivate the set of ultrasonic devices 308*a*-308*j*. Each ultrasonic device of the set of ultrasonic devices 308*a*-308*j* may be activated or deactivated simultaneously. In one embodiment, the modified dryer 300 may include a set of sensors (not shown) that senses a proximity of water thereto. The controller 312 may receive sensor data from the set of sensors and output the set of control signals based on the sensor data. For example, a sensor placed in a vicinity of an ultrasonic device 308*a* may output the sensor data indicating if a wet object is in contact with the ultrasonic device 308*a*. Based on the sensor data, the controller 312 may output a control signal to activate the corresponding ultrasonic device 308*a*.

Figure 3C:
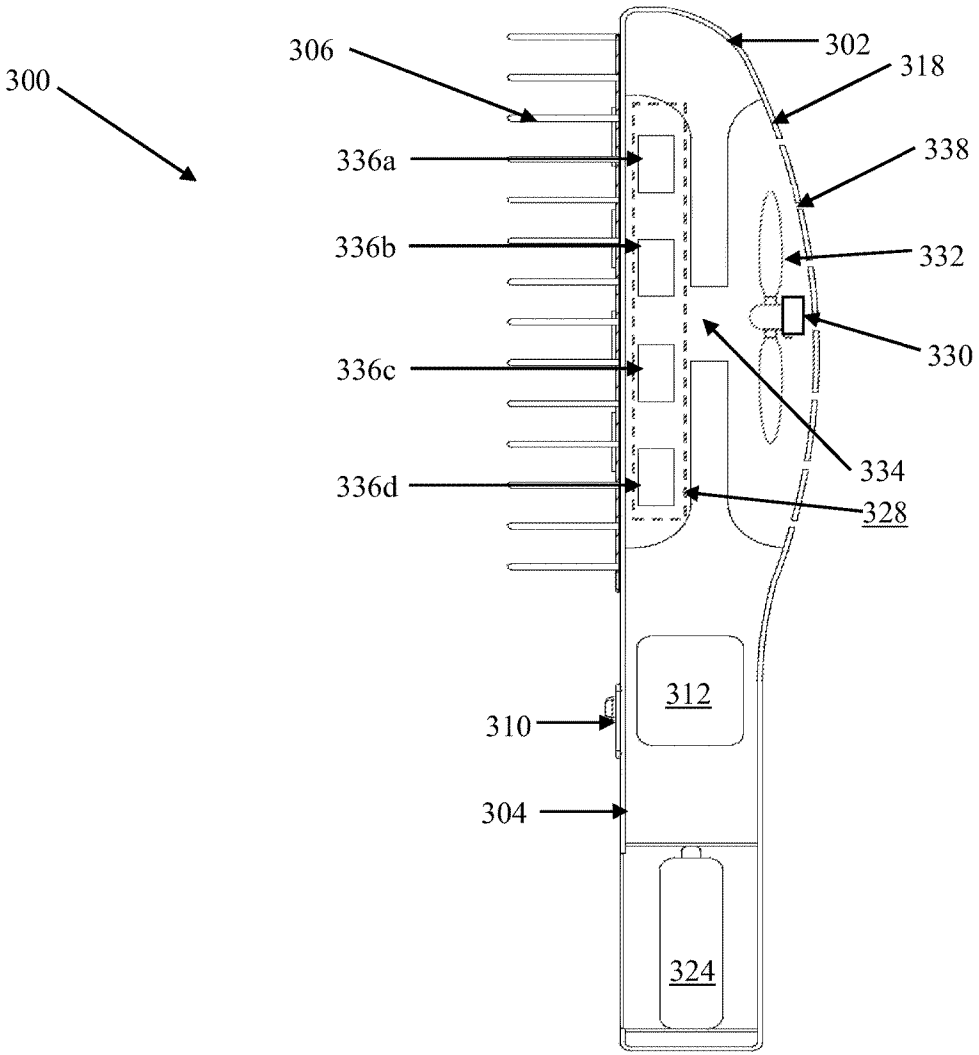
FIG. 3C illustrates a sectional view of the modified dryer of FIG. 3A, in accordance with an embodiment of the present invention.

FIG. 3C illustrates a side sectional view of the modified dryer 300, in accordance with an embodiment of the present invention. The handle 304 houses a power source 324 that powers the modified dryer 300. The power source 324 is used to provide power to the set of ultrasonic devices 308*a*-308*j*, the controller 312, and the control circuits 314. The power source 324 is positioned inside the handle 304 and is removable. In an embodiment, the power source 324 is a direct current (DC) power source, such as a battery. The use of the DC power source makes the modified dryer 300 portable. The power source 324 can be recharged by using an on-board charging circuit (not shown) or a Universal Serial Bus (USB) power source. The handle 304 includes a battery compartment 326 that facilitates removal of the power source 324. In another embodiment, the modified dryer 300 includes an electrical cord (not shown) that extends from the handle 304. The electrical cord allows the modified dryer 300 to connect to an alternating current (AC) power source.

As illustrated in FIG. 3C, the modified dryer 300 further includes a disinfection chamber 328 and a suction fan 330. The disinfection chamber 328 is in fluidic communication with the set of inlet holes 322. In the modified dryer 300, a first compartment 332 houses the suction fan 330. In an embodiment, the suction fan 330 is positioned inside the head 302. The disinfection chamber 328 and the first compartment 332 are interconnected with each other through a passage 334 in the head 302. Once the set of ultrasonic devices 308*a*-308*j* breaks down the water molecules from the surface of the hair or clothes, it is important to remove the mist thus formed. A failure in removal of the mist from the vicinity of the hair or clothes would result in absorption of the mist (which eventually condenses into water molecules) by the clothes or spread of the mist on the hair. This would render the drying process ineffective. The suction fan 330 ensures that the mist formed is immediately removed from the vicinity of the hair or clothes. The suction fan 330 generates vacuum that draws the mist towards the first surface 316 of the head 302. The suction fan 330 receives power from the power source 324. The set of inlet holes 322

(shown in FIG. 1A) formed on the first surface 316 allows the suction fan 330 to draw the mist towards the first surface 316 of the head 302. The set of inlet holes 322 is strategically positioned on the first surface 316 of the head 302 such that the mist formed is completely drawn towards the suction fan 330. The mist is drawn into the disinfection chamber 328 via the set of inlet holes 322 by the suction fan 330. The operation of the suction fan 330 may be controlled by the controller 312.

In an embodiment, the disinfection chamber 328 includes a set of ultraviolet light-emitting diodes 336*a*-336*d* to disinfect the mist. The number and position of ultraviolet light-emitting diodes may be varied such that the set of ultraviolet light-emitting diodes 336*a*-336*d* may efficiently and in entirety disinfect the mist that enters the disinfection chamber 328. For example, the modified dryer 300 may include 4, 6, or 8 ultraviolet light-emitting diodes to achieve effective disinfection of the mist. In an embodiment, each of the set of ultraviolet light-emitting diodes 336*a*-336*d* may be UV-C LED that operates in the C range of the UV spectrum. The operation of the set of ultraviolet light-emitting diodes 336*a*-336*d* may be controlled by the controller 312. A portion of the second surface 318 forms a wall for the first compartment 332. The portion of the second surface 318 has first set of vents 338 that allow the disinfected mist to discharge out of the modified dryer 300. In another embodiment, the disinfection chamber 328 may include a chemical means that disinfect the mist.

Figure 3D:
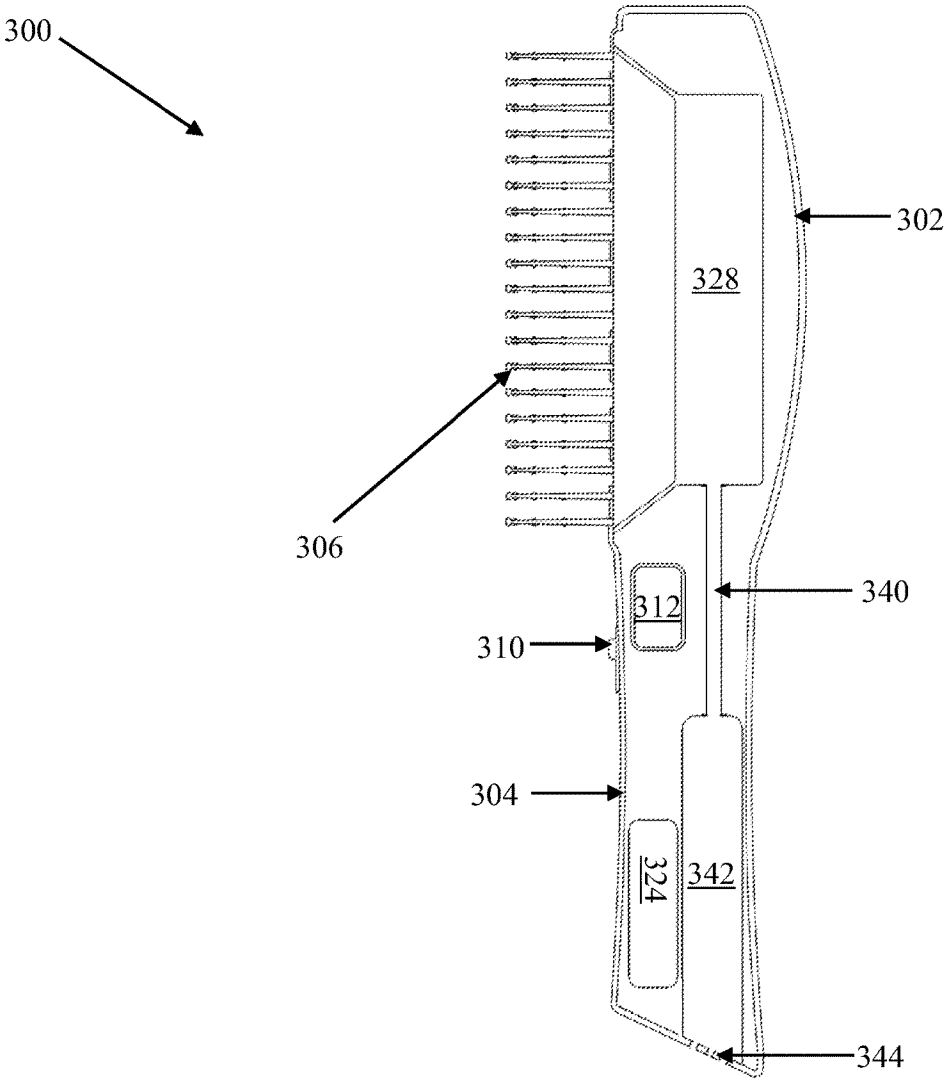
FIG. 3D illustrates a sectional view of the modified dryer of FIG. 3A, in accordance with another embodiment of the present invention.

As shown in FIG. 3D, in another embodiment, the suction fan 330 is positioned inside the handle 104 and is in fluid communication with the disinfection chamber 328 by way of a conduit 340. The dryer includes a second compartment 342 that houses the suction fan 330. The suction fan 330 creates a vacuum to allow the mist to enter the disinfection chamber 328. The disinfected mist moves further towards the suction fan 330 and exists the modified dryer 300 through a second set of vents 344. The second set of vents 344 are formed on a surface of the handle 304 that acts as wall of the second compartment 342. A person skilled in the art would understand that in order to move the mist the suction fan 330 and mist vents can be placed anywhere in the modified dryer 300.

In operation, the user activates the modified dryer 300 by way of the control switch 310. When the modified dryer 300 is activated, the controller 312 activates the control circuits 314 which in turn activate the set of ultrasonic devices 308*a*-308*j*. Upon activation, the set of ultrasonic devices 308*a*-308*j* produces ultrasonic vibrations. The user now brings the dryer 100 near hair. Upon contact with the hair, the ultrasonic vibrations break down the water molecules from a surface of the hair, thereby removing water molecules from the hair and drying them in the process. The mist thus formed is removed from the vicinity of the hair or clothes by the suction fan 330. The suction fan 330 is activated at the same time instance that the set of ultrasonic devices 308*a*-308*j* is activated. In an embodiment, the controller 312 controls an operation of the suction fan 330. The suction fan 330 creates vacuum that draws the mist towards the first surface 316 of the head 302 of the modified dryer 300 and inside the disinfection chamber 328 by way of the set of inlet holes 322. Once the mist passes through the disinfection chamber 328, the disinfected mist enters either one of first or second compartments 332 or 342 that houses the suction fan 330. The disinfectant mist may get discharged from the modified dryer 300 via the first or second set of vents 338 or 344.

The objective of the various embodiments of the modified dryer 300 is to allow the mist to pass through the disinfection chamber 328 before the mist escapes the modified dryer 300 without posing a risk of being ingested. Specific advantages of the present invention include the use of the modified dryer 300 to remove water from the hair or clothes. Further, the use of the set of ultrasonic devices 308*a*-308*j*, the disinfection chamber 328, and the suction fan 330 ensures that the hair is dried in a significantly efficient manner as compared to dryers known in the art. This is because the mist generated is instantly removed from the hair, thereby preventing it from getting spread back on the hair.

Techniques consistent with the present invention provide, among other features, a dryer to dry an object. While various exemplary embodiments of the disclosed system and method have been described above it should be understood that they have been presented for purposes of example only, not limitations. It is not exhaustive and does not limit the invention to the precise form disclosed. Modifications and variations are possible in light of the above teachings or may be acquired from practicing of the invention, without departing from the breadth or scope.

In the claims, the words 'comprising', 'including' and 'having' do not exclude the presence of other elements or steps then those listed in a claim. The terms "a" or "an," as used herein, are defined as one or more than one. Unless stated otherwise, terms such as "first" and "second" are used to arbitrarily distinguish between the elements such terms describe. Thus, these terms are not necessarily intended to indicate temporal or other prioritization of such elements. The fact that certain measures are recited in mutually different claims does not indicate that a combination of these measures cannot be used to advantage.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claims.

What is claimed is:

1. A dryer comprising:

a head having a surface;

a handle attached to the head;

a plurality of ultrasonic devices positioned on the surface of the head, wherein the plurality of ultrasonic devices produce ultrasonic vibrations that break down water molecules into mist;

a disinfection chamber positioned inside the head to disinfect the mist;

a suction fan in fluidic communication with the disinfection chamber to generate vacuum that draws the mist towards the surface of the head and into the disinfection chamber; and a controller to control operations of the plurality of ultrasonic devices and the suction fan.

2. The dryer of claim 1, wherein a plurality of inlet holes are formed on the surface of the head to allow the suction fan to draw the mist towards the surface of the head.

3. The dryer of claim 2, wherein the plurality of inlet holes are in fluidic communication with the disinfection chamber.

4. The dryer of claim 1, wherein the disinfection chamber comprises a set of ultraviolet light-emitting diodes that disinfect the mist within the disinfection chamber.

5. The dryer of claim 1, further comprising a plurality of control circuits corresponding to the plurality of ultrasonic devices, wherein the plurality of control circuits are connected to the controller for receiving at least one control signal, and control the operations of the plurality of ultrasonic devices based on the at least one control signal.

6. The dryer of claim 1, wherein each of the plurality of ultrasonic devices is a piezoelectric transducer.

7. The dryer of claim 1, further comprising a plurality of bristles protruding from the surface of the head.

8. The dryer of claim 1, further comprising a power source to power the dryer, wherein the power source is at least one of a direct current (DC) or an alternating current (AC) power source.

9. The dryer of claim 1, further comprising a control switch to control an operation of the dryer.

10. The dryer of claim 1, wherein a set of vents are formed on a surface of the dryer in proximity to the suction fan to discharge the disinfected mist from the dryer.

* * * * *